United States Patent [19]

Spillman

[11] Patent Number: 4,676,547

[45] Date of Patent: Jun. 30, 1987

[54] PORTABLE SPECTATOR'S STOOL

[76] Inventor: Robert L. Spillman, 1266 S. Front St., Columbus, Ohio 43206

[21] Appl. No.: 926,679

[22] Filed: Nov. 4, 1986

[51] Int. Cl.[4] ..... A47C 1/00

[52] U.S. Cl. ..... 297/4; 248/122

[58] Field of Search ..... 297/4; 248/155, 155.4, 248/230, 122

[56] References Cited

U.S. PATENT DOCUMENTS

| | | | |
|---|---|---|---|
| 3,957,372 | 4/1976 | Casler et al. | 248/230 |
| 3,985,387 | 10/1976 | Rischar | 297/4 |
| 4,402,481 | 9/1983 | Sasaki | 248/122 |

FOREIGN PATENT DOCUMENTS

| | | | |
|---|---|---|---|
| 1184781 | 3/1980 | United Kingdom | 297/4 |

*Primary Examiner*—Kenneth Downey

*Attorney, Agent, or Firm*—William S. Rambo; Wm. Cates Rambo

[57] ABSTRACT

A portable knockdown-type stool for use by a spectator of a sporting event features a seat and frame normally supported in elevated relation to the ground by a single, readily detachable leg or post and having a detachable, stabilizing handle or bar disposed in laterally offset relation to the seat and adjustable between relatively upwardly extended, or downwardly retracted position with respect to the seat. In its retracted position, the handle provides a convenient mean for carrying the stool from place to place and when extended it provides either a back rest or prop for a person seated on the stool.

1 Claim, 5 Drawing Figures

PORTABLE SPECTATOR'S STOOL

BACKGROUND OF THE INVENTION

This invention relates generally to portable seats or stools of the type used by spectators of sporting events, hikers, hunters in the field, or the like. More specifically this invention is concerned with an improved, knock-down-type, portable, single leg stool upon which a person may sit while maintaining balance with his (her) two legs and feet.

The prior art is crowded with examples of portable, single legged stools, shooter's sticks and seats which are capable of being carried handily to and from sporting events, hunts and various other outdoor activities and which provide a convenient seat upon which a spectator or participant may sit and rest. Typical examples of such portable stools or seats are disclosed in the following U.S. Patents which represent the most pertinent prior art known to the applicant:

| U.S. Pat. No. | Issued | Inventor(s) |
|---|---|---|
| 177,025 | May 2, 1876 | Smith |
| 690,122 | Dec. 31, 1901 | Slagle |
| 759,809 | May 10, 1904 | Farley |
| 954,473 | Apr. 12, 1910 | Schocke |
| 1,697,552 | Jan. 1, 1929 | Brooks |
| 4,098,478 | Jul. 4, 1978 | Spitzke |
| 4,433,870 | Feb. 28, 1984 | Bairen et al |

However, so far as the applicant is aware, no one has heretofore proposed or disclosed a portable, knock-down-type, spectator's stool having a single supporting leg and which is also provided with a linearly adjustable handle member or bar disposed in laterally offset relation to the seat of the stool and which may be used, either as a stabilizing handle, or as a back rest for the person sitting on the stool.

SUMMARY AND OBJECTS OF THE INVENTION

This invention provides a portable, knockdown-type, spectator's stool which includes a frame member to which is secured a generally flat seat and which is formed or otherwise provided with a leg-receiving socket disposed in alignment with the center of the seat and a handle-receiving bore disposed in laterally offset relation to the seat. A single, elongated leg member has its upper or inner end removably carried in the socket of the frame member and an elongated handle member or post is carried in the handle-receiving bore and is adjustable between relatively upwardly extended and retracted positions with respect to the seat of the stool. When occupying its upwardly extended position, the handle member may be straddled and grasped by a person sitting upon the seat to stabilize the weight load on the stool. The handle member may also be used as a back rest simply by positioning it adjacent to the user's back when as he mounts the seat of the stool. The extent of upward projection, or height, of the handle member above the seat may be adjusted to suit the comfort of the user.

The primary object of this invention is to provide a readily portable, knockdown-type, spectator's stool which is equipped with an adjustable handle or post member arranged to extend vertically upwardly along one side of the seat of the stool to provide either a hand rest or a back rest for a person sitting upon the stool.

Other objects and advantages of the invention will become readily apparent from the following description.

DESCRIPTION OF PREFERRED EMBODIMENT OF THE INVENTION

With reference to the drawings, it will be seen that the present spectator's stool includes a generally circular seat 10 having a padded cover and/or cushion 11 on its upper or outer surface. The seat 10 is suitably secured, as by means of screws, adhesive, or both, not shown, to and upon a block or bar-form frame member 12. The frame member 12 extends generally transversely or radially across the under surface of the seat 10 and has an outer end portion 13 which extends a distance laterally or radially outwardly beyond the marginal edge of the seat 10.

Figure 3:
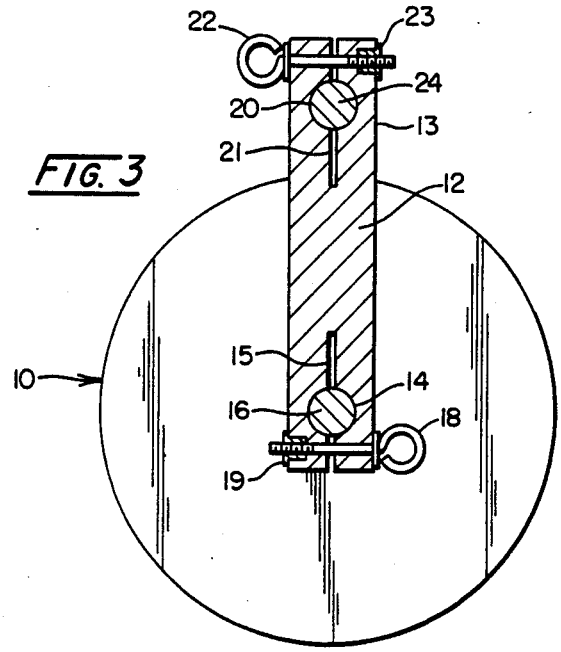
FIG. 3 is a transverse vertical sectional view taken approximately along the line 3—3 of FIG. 4.

As shown particularly in FIG. 3, the frame member 12 is formed toward its inner end with a leg-receiving socket 14 which is intersected by a comparatively narrower slot or cut 15. The socket 14 is sized to receive the upper or inner end of an elongated, generally cylindrical leg 16. The outer or lower end of the leg 16 is preferably equipped with a resiliently compressible crutch tip 17 which is frictionally telescoped over the end of the leg.

Extending transversely through the inner, slotted end of the frame piece 14 is a manually operable eye bolt 18. The eye bolt 18 has an outer screw-threaded end portion which is threadedly engaged with a nut 19 partially embedded in the frame piece 14. When the bolt 18 is tightened in the nut 19, the walls of the slot 15 are drawn inwardly toward one another to contract the socket 14 and frictionally clamp the upper end of the leg 16 within the socket. Conversely, by loosening the eye bolt 18, the socket is effectively expanded to release its grip upon and permit removal of the leg 16 from the socket 14.

Figure 1:
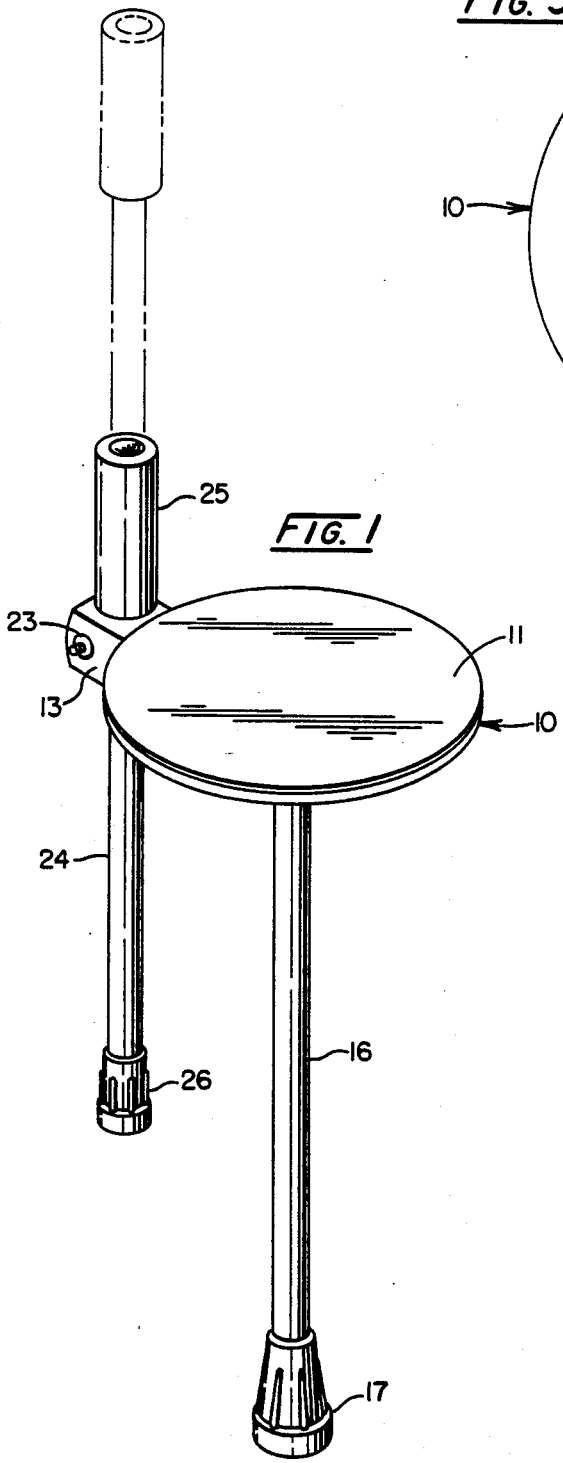
FIG. 1 is a perspective view of a spectator's stool according to this invention showing in broken lines an adjusted position of the handle member of the stool.

The outer or laterally extended end portion 13 of the frame piece 12 is similarly formed with a cylindrical socket or bore 20 intersected by a slot or cut 21 extending inwardly from the outer end of the frame piece 12. A clamping eye bolt 22 extends transversely through the slotted outer end of the frame piece 12 and is threadedly engaged with a countersunk nut 23. An elongated, dowel-like handle or post member 24 is carried in the bore 20 of the frame 12 and may be vertically adjusted between relatively vertically extended and retracted positions with respect to the seat 10. FIGS. 1 & 3 of the drawings show the handle member 24 in its relatively vertically retracted position, while FIGS. 2 & 5 and the broken lines of FIG. 1 show the handle member in its vertically extended position. As will be understood, adjustment of the handle member 24 with respect to the seat 10 is accomplished simply be loosening the eye bolt 22 in the nut 23 and sliding the handle member 24 axially within the bore 20 to a desired position. The handle member 24 may be securely clamped in its selected position by tightening the eye bolt 22 in the nut 23 and thus causing the walls of the bore 20 to contract into frictional engagement with the handle member. A sleeve-like hand grip or pad 25 of resiliently compressible rubber or elastomeric plastic is preferably carried on the outer end portion of the handle member 24 and the opposite or inner end of the handle member may be equipped with a readily removable cane or crutch tip 26.

Figure 2:
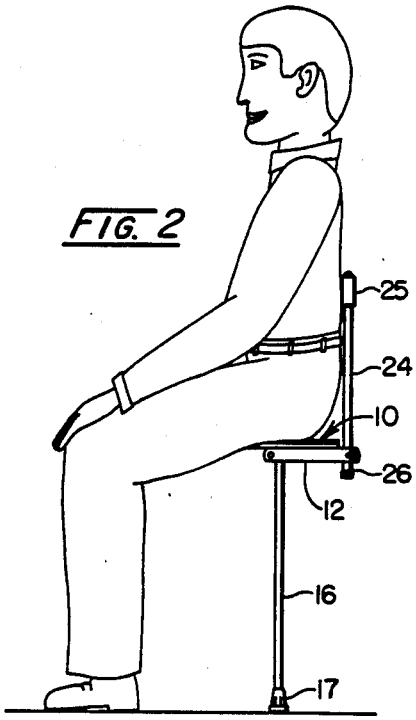
FIG. 2 is a side elevational view, on a relatively reduced scale, showing the stool in one of its positions of use.
Figure 4:
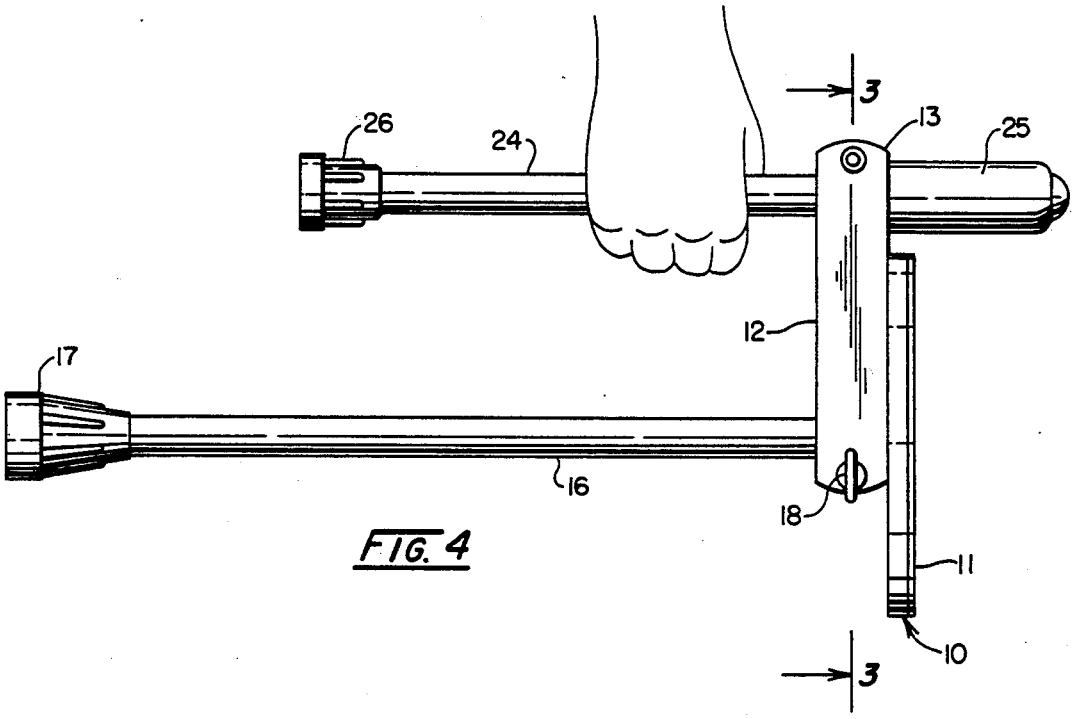
FIG. 4 is an elevational view of the stool with its handle member occupying a "carry" position.
Figure 5:
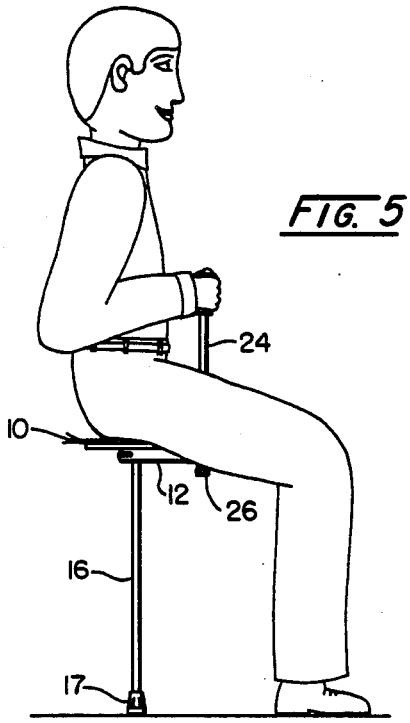
FIG. 5 is an elevational view similar to FIG. 2, but illustrating the stool in another position of use.

When it is desired to carry the stool, the handle member 24 is preferably adjusted and clamped in its relatively retracted position as shown by full lines in FIGS. 1 & 4, so as to minimize the overall length of the stool and make it more compact and easy to carry. However, when it is desired to use the stool for sitting, the handle member is adjusted to and clamped tightly in its vertically extended position as shown by broken lines in FIG.1. With the handle locked in extended position, a person may either sit upon the seat 10 by straddling and gripping the handle member 24 as shown in FIG. 5, or by facing away from and resting his back against the handle member 24 as illustrated in FIG. 2. In either position, the vertically extended handle member adds greatly to the comfort of the user and adds stability against undesired toppling of the stool.

When it is desired to package and/or stow the stool in compact condition, the leg 16 may be easily removed from the socket 14 of the frame 12 by loosening the eye bolt 18, and the handle member may also be removed from the bore 20 of the frame simply by removing the tip 26 and loosening the eye bolt 22.

In view of the foregoing, it will be appreciated that this invention provides a highly versatile, yet mechanically simple, knockdown-type, portable spectator's stool which is characterized by improved stability and comfort to the user.

While a presently preferred embodiment of the invention has been illustrated and described in detail, it should be understood that modifications in details of construction and design may be resorted to without departing from the spirit of the invention or the scope of the following claims.

I claim:

1. A portable spectator's stool comprising: a seat; a frame member secured to and extending generally transversely beneath said seat, said frame member being formed with a downwardly opening socket disposed in general alignment with the central portion of said seat and an end portion extending laterally outwardly beyond a marginal edge of said seat, the end portion of said frame member including a split bore extending therethrough and having an axis disposed in generally parallel, but laterally offset relation to the axis of the downwardly opening socket of said frame member; a single, elongated leg having an upper end portion detachably carried in the downwardly opening socket of said frame member; an elongated handle member carried in the split bore of said frame member and adjustable therein between relatively vertically extended and retracted positions with respect to said seat; and means connected with said frame member for releasably clamping said handle member in its vertically extended on retracted positions.

* * * * *